US005127613A

United States Patent [19]

Germann

[11] Patent Number: 5,127,613

[45] Date of Patent: Jul. 7, 1992

[54] RAIL SWITCHING DEVICE INCLUDING AN ANTIFRICTION INSERT

[75] Inventor: Urs Germann, Küssnacht, Switzerland

[73] Assignee: Magna Holding Anstalt, Vaduz, Liechtenstein

[21] Appl. No.: 585,158

[22] PCT Filed: Feb. 12, 1990

[86] PCT No.: PCT/EP90/00229

§ 371 Date: Oct. 9, 1990

§ 102(e) Date: Oct. 9, 1990

[87] PCT Pub. No.: WO90/09484

PCT Pub. Date: Aug. 23, 1990

[30] Foreign Application Priority Data

Feb. 10, 1989 [DE] Fed. Rep. of Germany ..... 3904026

[51] Int. Cl.[5] ..... E01B 7/26

[52] U.S. Cl. ..... 246/453; 246/430

[58] Field of Search ..... 246/415 R, 430, 435 R, 246/444, 453

[56] References Cited

U.S. PATENT DOCUMENTS

| | | | |
|---|---|---|---|
| 752,517 | 2/1904 | Carter | 246/453 |
| 4,105,175 | 8/1978 | DeSpiegeleer | 246/453 X |
| 4,131,255 | 12/1978 | Menia | 246/430 |
| 4,890,804 | 1/1990 | Teramoto et al. | 246/453 |

FOREIGN PATENT DOCUMENTS

| | | | |
|---|---|---|---|
| 232726 | 8/1987 | European Pat. Off. . | |
| 1918253 | 4/1965 | Fed. Rep. of Germany . | |
| 2729723 | 1/1979 | Fed. Rep. of Germany . | |
| 3743368 | 7/1989 | Fed. Rep. of Germany | 246/444 |
| 2356766 | 1/1978 | France . | |
| 2398841 | 3/1979 | France | 246/430 |
| 2423584 | 12/1979 | France | 246/430 |
| 2202563 | 9/1988 | United Kingdom | 246/430 |

*Primary Examiner*—Robert J. Spar
*Assistant Examiner*—Scott L. Lowe
*Attorney, Agent, or Firm*—Cushman, Darby & Cushman

[57] ABSTRACT

The antifriction insert (1) for slide surfaces of switching devices is fixed to a base member (5) in that the base member includes a recess with grooves at both sides. At least one of the grooves has upwardly open hollows (9). The antifriction insert has projections associated with these hollows (9) so that the antifriction insert can be introduced from above into the base member (5) and then only needs to be displaced by the length of the projections in order to obtain safe securing.

8 Claims, 3 Drawing Sheets

RAIL SWITCHING DEVICE INCLUDING AN ANTIFRICTION INSERT

BACKGROUND OF THE INVENTION

The invention relates to an antifriction insert for switching devices and also for slide surfaces for movable frog points to support a tongue or point of a frog which is movable with respect to a firmly mounted stock rail, the antifriction insert being fixed on a base member, arranged to be stationary with respect to the stock rail and so as to extend at right angles relative to the web thereof, and comprising a plurality of antifriction bodies of self-lubricating material retained in a rectangular frame.

Such an antifriction insert is known from EP-A-232 726 and DE-GM 87 00 566.2, respectively.

The antifriction insert consists of a sheet metal frame with breakthroughs in which the antifriction bodies are placed. A tongue or movable point of a frog rests with its bottom surface on these antifriction bodies which project above the surface of the slide chair and sheet metal frame.

For assembly, the antifriction insert is pushed into the recess mentioned above.

The frame in which the antifriction insert is disposed is lifted at its front end by means of a tool and pulled out of the recess in order to be able to exchange an antifriction insert of such design upon wear or destruction.

An antifriction coating of plastics for rail switches is known from DE-AS 26 31 594 with which a tongue is movable back and forth, sliding with respect to a rail, on a switch chair coated with plastics, and the plastics antifriction coating is arranged in a recess of the switch chair in such manner that it projects above the surface of the switch chair. The slipping of the tongue on the surfaces of plastics strips guarantees the functional reliability of the switch since the strips always maintain their planar shape due to their free movability or extensibility in all directions and do not become warped upwardly.

Moreover, an antifriction plate of plastics for a rail switch with switch chair and sliding switch blade is known from DE-OS 34 06 726, wherein the tongue is displaceable, substantially in a horizontal plane, on the surface of the antifriction plate received by the switch chair and accommodates load forces which are substantially vertical or inclined with respect to the horizontal, through the antifriction plate. The antifriction plate of plastics in this case is carried on a surface extending substantially horizontally of the switch chair and is retained between the lateral limiting strips thereof.

DE-GM 19 18 253 shows a streetcar rail switch with a tongue which is displaceable on an antifriction insert carried by a bottom member which is fixed both to the travelling rail and the side rail. The antifriction insert is fixed at both sides in a dovetail guide. For this reason, it can be exchanged only by pushing-in in a longitudinal direction, and that requires the complete dismantling of the entire streetcar rail.

OE-PS 319 990 shows a frog with a movable point which slides on an antifriction plate. This antifriction plate must be lubricated at regular intervals. It cannot be taken from this publication how the antifriction plate is fastened at the frog.

DE-PS 438 513 shows a way of supporting switch blades in the case of streetcar rail switches wherein the foot of the tongue is broader than the flange groove.

Insertion of the switch blade or tongue into the streetcar rail is permitted by the fact that a recess is provided at the head of the side rail, which allows the tongue to be inserted laterally and then tilted.

Antifriction inserts of the kind mentioned initially are parts that are subject to wear and must be replaced from time to time—even if they have a long service life. This exchange is quite expensive with all the known antifriction inserts. Also in the case of the dovetail guide according to DE-GM 27 247 the antifriction insert must be pulled or beaten out of the dovetail guide means for its full length, and in practice that is possible with great difficulty only after the antifriction insert has had a prolonged period of service in the track since contamination and perhaps also corrosion hardly permit any displacement of the antifriction insert in the dovetail guide means. The cramped space available with streetcar rail switches renders the disassembly and renewed installation particularly difficult and, in most cases, requires total dismantling of the switch.

SUMMARY OF THE INVENTION

It is, therefore, the object of the invention to provide a maintenance-free antifriction insert which can readily be exchanged.

This object is met, with an antifriction insert of the kind mentioned initially, in that the base member has a rectangular recess to receive the frame, that this recess includes undercut grooves in both its sides which extend at right angles with respect to the stock rail, that the frame has a projection at at least one of its sides which extend at right angles with respect to the stock rail, that at least one of the grooves includes at least one upwardly open hollow to take up the associated projection, and that the hollow is disposed in the longitudinal direction of the groove such that the projection will be located offset with respect to the hollow when the antifriction insert is in completely assembled condition.

As regards the method, this object is met in that the antifriction insert is introduced obliquely from above into the one groove by its one side which extends vertically with respect to the stock rail, that subsequently the antifriction insert is tilted into horizontal position with its projection coming to lie in the recess of the other groove, and in that finally the antifriction insert is pushed forward in the direction of the stock rail and locked.

The antifriction insert consequently no longer needs to be displaced with respect to the base member for its full length but instead only for the length of the projections, whereby the expenditure is reduced considerably. That is caused by various factors:

The frictional forces for displacing the antifriction insert are less because only the projections present effective frictional surfaces and, therefore, seizing by contamination etc. occurs less frequently;

the displacement distance is less, and that has the additional advantage that even under tight conditions of installation, especially with tongue switches of streetcar rails, the antifriction insert can be exchanged readily without the need for dismantling the entire switching device.

Still, reliable fastening of the antifriction insert at the base member is achieved.

According to one aspect of the invention the projections or hollows are at one side only of the antifriction insert, while the groove in the base member extends for the full length at the other side.

It proved to be especially favorable, according to another aspect of the invention, if three projections are provided at the antifriction insert and, accordingly, three recesses at the groove of the base member.

Further advantageous modifications and further developments of the invention may be taken from the subsidiary claims.

The invention thus provides an antifriction insert for switching devices which insert can be exchanged readily even in the case of switch deflecting devices of streetcar rails where cramped conditions in space are to be taken into account. By virtue of the materials used, this antifriction insert is maintenance-free and need not be lubricated. Lubrication, by the way, is disadvantageous in that the lubricant, upon heating, evaporates at least partly and even may suffer resinification so that new lubricant must be applied, even up to twice a day in individual cases. Part of the lubricant also leaks into the underground water and that is highly alarming with oil-containing lubricants. The self-lubricating effect is achieved by the antifriction bodies being made of self-lubricating antifriction metal, especially of graphite bronze whose coefficient of friction proved to be constant up to 1 million strokes in comparative tests. These antifriction bodies are embodied by rondelles inserted in the form of interference fit in blind holes in a frame of the antifriction insert.

In designing the antifriction insert for switching devices of streetcar rails use is made, for the mounting and dismounting, of the water channel which normally is present in streetcar rails and the width of which corresponds approximately to the width of one of the projections at the frame of the antifriction insert.

BRIEF DESCRIPTION OF THE DRAWINGS

The invention will be described further, by way of example, with reference to the accompanying drawings, in which.

DETAILED DESCRIPTION OF THE PREFERRED EMBODIMENT

The invention will be described below with reference to an antifriction insert for the switching device of a streetcar rail. Yet it should be noted that the invention may be applied to any kind of switch deflecting device, i.e. also with so-called open tongue operating devices.

Figure 1:
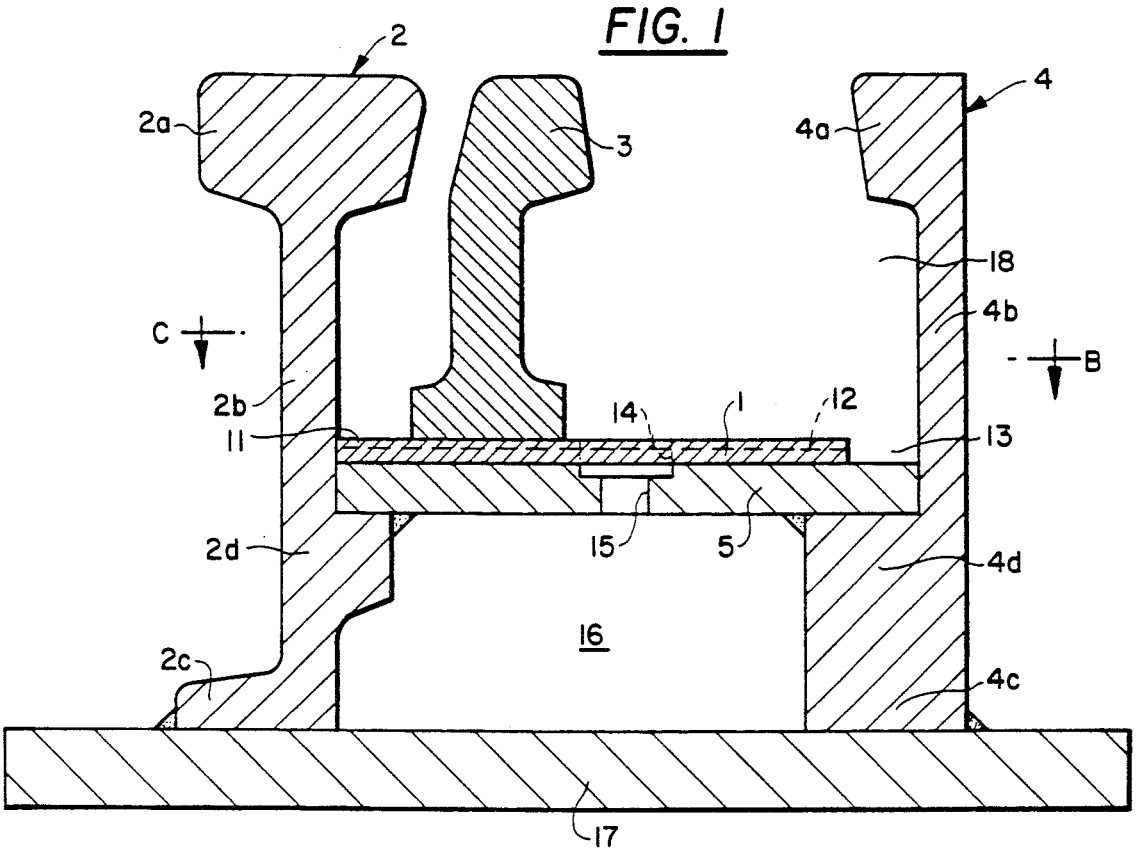
FIG. 1 shows a cross section of the streetcar rail switching device with the base member and the antifriction insert.

FIG. 1 shows a streetcar rail consisting of a stock rail 2 and a side or guard rail 4. The stock rail 2 and the guard rail 4 each have a head 2*a* and 4*a*, respectively, tapering downwardly into a web 2*b* and 4*b*, respectively. At their parts remote from the respective head 2*a*, 4*a* both webs 2*b* and 4*b* are formed vertically with shoulders 2*d*, 4*d* on which the lower surface of the base member 5 of the slide base rests in part. Firm connection between the stock rail 2 and the guard rail 4 is obtained by welding between the base member 5 and the shoulders 2*d* and 4*d* of the webs 2*b* and 4*b*. At the same time the foot 2*c* of the stock rail 2 and the foot 4*c* of the guard rail 4 are welded to a bottom plate 17.

A free space is defined between the heads 2*a* and 4*a* of the stock rail 2 and the guard rail 4 next to a tongue 3. With streetcar rail switching devices its function is to receive the wheel flange of a rail car, especially a streetcar or tram to guide the wheel set in a track, as is the case with conventional streetcar switches comprising individual slide chairs and streetcar rail switch deflecting devices. Within the free space thus formed the wheel flange therefore can move without difficulty in the longitudinal direction in the switching device.

A tongue 3 of a switch is disposed between the free space defined by the heads 2*a* and 4*a* and, in operation, it may be engaged selectively with one or the other head 2*a*,4*a*. As the wheel of a rail car either rests on top of the tongue 3 or not, depending on the travelling direction, the forces caused by the weight and acting on the tongue 3 must be accommodated by the base member 5 of the slide base. An antifriction insert 1 is disposed on the top of the base member 5 and it greatly reduces the frictional force originating from the movement of the tongue 3 upon changeover of the switch.

The antifriction insert 1 has blind holes or breakthroughs in which antifriction bodies 6 are inserted in snug fit. These antifriction bodies 6 are made of self-lubricating antiseize metal, especially of graphite bronze and preferably extend beyond the surface of the antifriction insert 1. They are formed as rondelles which are arranged offset in the longitudinal direction of the antifriction insert 1. The surface of the tongue 3 opposite the wheel support rests on the surface of the antifriction bodies 6.

In the cross sectional view of FIG. 1 which shows the antifriction insert in an installed position, the antifriction insert 1 lies in planar contact on the base member 5, having been moved with its one section 11 to abut against the inside of the web 2*b* of the stock rail 2. The opposite end section 12 of the antifriction insert is spaced from the inside of the web 4*b* of the guard rail, this spacing forming a channel 13. This channel serves to drain water.

In the antifriction insert and in the base member there is a bore 14 and 15 each. When installed, these bores are aligned. A locking pin (not shown) may be introduced into this bore. Below the base member there is a free space 16 defined by the bottom plate 17. The upwardly open, inner space of the switching device defined by the base member 5 and the webs of the two rails 2 and 4 is marked by reference numeral 18.

Figure 2:
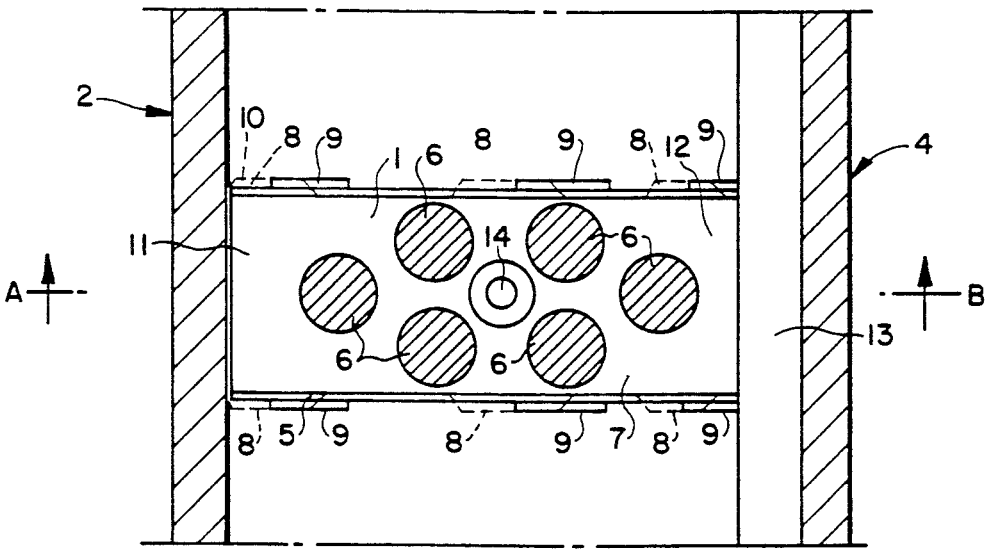
FIG. 2 shows a section along line B-C of FIG. 1 in top plan view of the streetcar rail.

FIG. 2 shows a section along line B-C of FIG. 1. The antifriction insert 1 consists of a frame 7 with antifriction bodies 6 attached to it. With this embodiment three mutually spaced, outwardly protruding projections each are provided at the two longer sides of the frame 7. The base member 5 has a rectangular recess, both sides of which that extend at right angles with respect to the guard rail are formed with undercut grooves 10, preferably of wedge shape or dovetail configuration in cross section. The grooves have upwardly open hollows 9 which are dimensioned so that the projections 8 of the frame can be introduced from above. In the longitudinal direction of the grooves, the hollows 9 are arranged such that the projections 8 will be offset with respect to the hollows 9, thereby being retained in the grooves 10, when the antifriction insert I is in its fully assembled position with the end section 11 abuting against the stock rail 2.

The length of the projections 8 in the direction of pushing them in is the same as or smaller than the width of the channel 13. In the case of the embodiment for switching devices of streetcar rails, the length of the diagonal of the antifriction insert 1 is smaller than the spacing between the webs 2*b* and 4*b* of the two rails 2 and 4 so that the antifriction insert 1 can be turned by 90° in the horizontal plane (plane of the drawing of FIG. 2). Furthermore, the width of the antifriction insert corresponds approximately to the distance between the two heads 2*a* and 4*a* so that the antifriction insert 1 can be introduced from above into the space 18.

To mount the antifriction insert, the following steps are taken:

To begin with, the antifriction insert 1 is introduced from above into the free space 18 formed between the heads 2*a* and 4*a* of the two rails 2 and 4, the antifriction insert being oriented such that its two longer sides extend approximately parallel to the longitudinal direction of the two rails 2 and 4. During this step the antifriction insert may be tilted with respect to the plane of the base member 5 so that it will pass between the two heads 2*a* and 4*a* of the two rails 2 and 4. As soon as the antifriction insert has been introduced past the two heads 2*a* and 4*a* into the space 18, it is rotated through 90° parallel to the plane defined by the base member 5 and oriented such that the projections 8 will lie above the hollows 9. Thereupon the antifriction insert is lowered and then advanced in the direction toward the stock rail 2 so that the projections 8 will become engaged in the undercut grooves 10. The final position is reached when the front section 11 of the antifriction insert comes to lie against the web of the stock rail. Then also the bores 14 and 15 are aligned and the locking pin can be beaten in. During these operations, of course, the tongue 3 is not in place.

Instead of the locking pin, any other locking measure may be taken, such as a locking member positioned in the range of the channel 13 to press the antifriction insert 1 against the stock rail 2. This member, for instance, may be a spring supported on the web 4*b* of the guard rail 4 and on the end section 12 of the anifriction insert.

Disassembly of the antifriction insert takes place in the opposite order. First, the locking member is removed. If the locking member used is a pin, it is beaten down all the way through into the space 16. Then the antifriction plate is displaced toward the guard rail 4 until the projections 8 are aligned with the hollows 9 and the antifriction insert 1 can be lifted upwardly. It is obvious that the path of displacement needed for disassembly is very short and this facilitates the disassembling.

Figure 3:
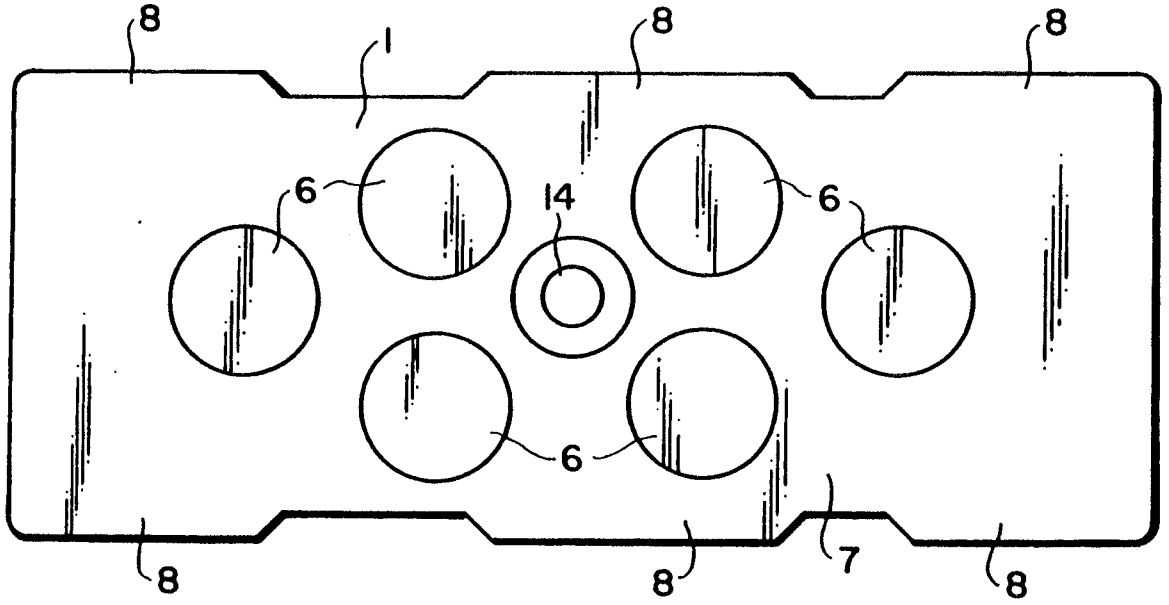
FIG. 3 is a top plan view of a first embodiment of an antifriction insert.

FIG. 3 is a top plan view of the antifriction insert shown in FIGS. 1 and 2. Essentially this embodiment is characterized in that there are three projections 8 each at the two longer sides of the frame 7.

Figure 4:
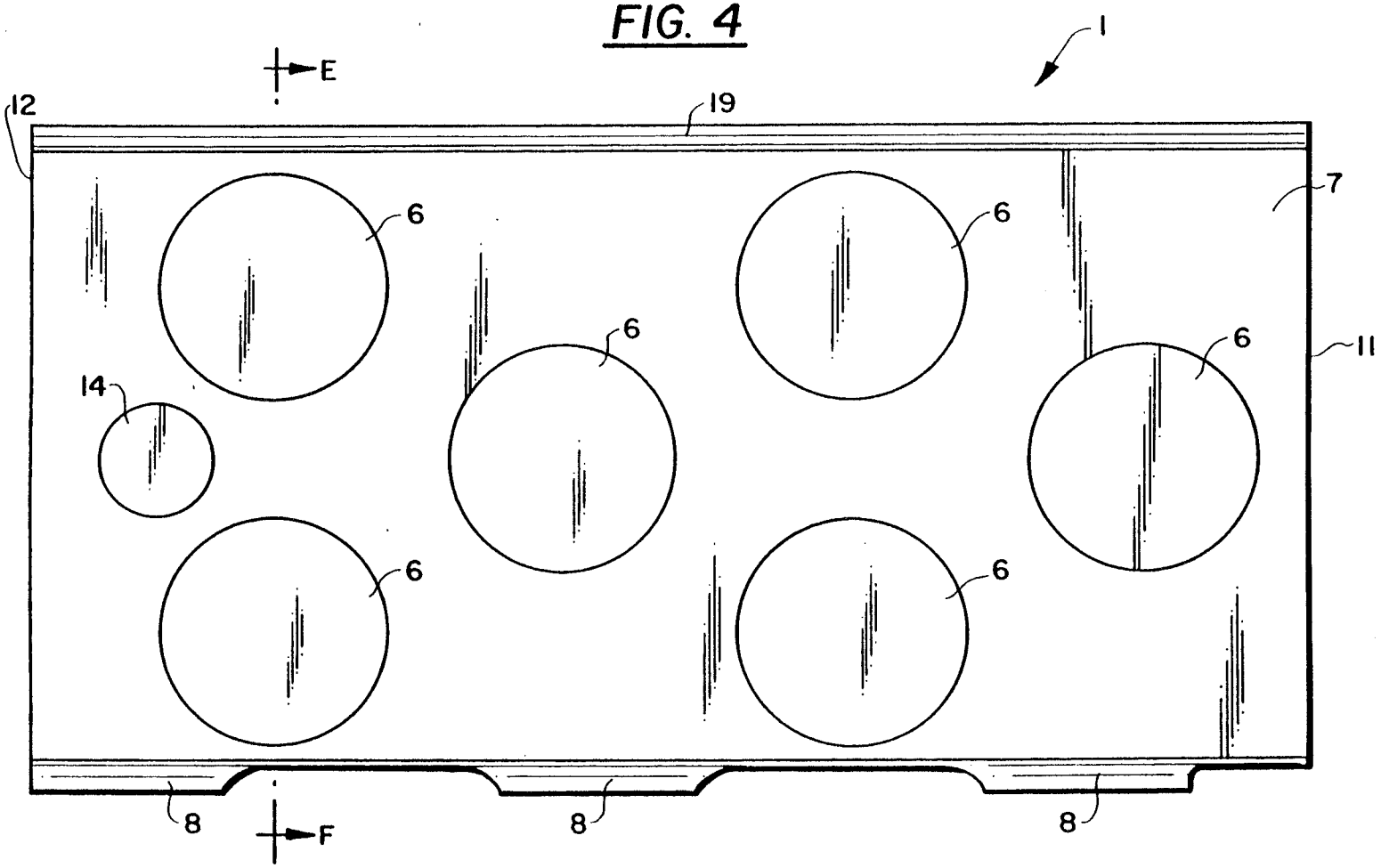
FIG. 4 is top plan view of a second, preferred embodiment of the antifriction insert.

FIG. 4 shows a top plan view of a second embodiment of the antifriction insert similar to FIG. 3. Here the antifriction insert has three projections 8 at one side only, while it comprises a chamfer 19 throughout the entire longitudinal direction at the opposite side. The base member 5, accordingly, has one continuous groove at one side, while the groove at the opposite side has the three hollows 9. In this case the antifriction insert, having been properly oriented with respect to the base member 5, is inserted from above first such that the chamfer 19 will engage in the corresponding groove. Only thereafter is the antifriction insert tilted downwardly into the horizontal position with the projections 8 being inserted in the hollows 9 (cf. FIG. 3). The other steps are taken in the manner described above.

Figure 5:
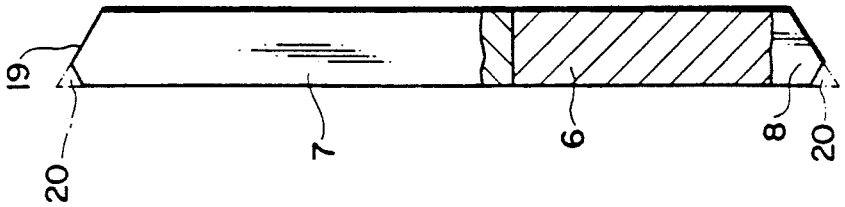
FIG. 5 is a cross section of the antifriction insert shown in FIG. 4.

FIG. 5 shows a cross section of the antifriction insert as seen along the line of cut E-F. It may be seen here that both long sides of the antifriction insert are oblique, looking from the top, in correspondence with the configuration of the grooves 10 in the base member 5. In the embodiment illustrated the chamfers 19 are rectilinear throughout from the upper to the lower sides of the antifriction insert. The resulting tip may be bevelled 20 so as to assure easy slipping of the antifriction insert with respect to the base member 5.

What is claimed is:

1. A rail switching device comprising:

a firmly mounted stock rail;

a base member disposed stationary relative to said stock rail and extending perpendicularly to a longitudinal direction of said stock rail, said base member having a rectangular recess, said rectangular recess including undercut grooves in each elongated side thereof extending perpendicular to said longitudinal direction of said stock rail, at least one of said grooves including three upwardly opening hollows disposed in a longitudinal direction of said groove;

an antifriction insert affixed to said base member and stationary with respect to said stock rail, said antifriction insert comprising a rectangular frame including a plurality of antifriction bodies of self-lubricating material, said rectangular frame disposed in said rectangular recess of said base, said frame including three projections disposed on at least one side thereof and extending perpendicularly to said longitudinal direction of said stock rail; and a movable switching member disposed on said antifriction insert parallel to said stock rail, said switching member movable with respect to said stock rail and said insert;

said hollows accepting said projections therein, said projections being disposed in an offset position with respect to said hollows to retain said projections in said groove when said antifriction insert is in a completely assembled condition.

2. A rail switching device as defined in claim 1 further comprising a firmly mounted guard rail parallel to said stock rail, said stock rail and said guard rail each having a head portion tapering downward into a web portion, said web portions disposed perpendicular to said antifriction insert, said web portions separated by a distance, the longest diagonal length of said insert being smaller than said distance.

3. The rail switching device as claimed in claim 1, wherein only one of said grooves includes said three hollows, said frame accordingly having said projections at one side only.

4. The rail switching device as claimed in claim 1, wherein said projections and said grooves are of dovetail shape in cross section.

5. The rail switching device as claimed in claim 1, further comprising at least one locking member to lock said rectangular frame with respect to said base member.

6. The rail switching device as claimed in claim 5, wherein said locking member includes a pin adapted to be inserted in a bore which extends through said rectangular frame and said base member.

7. A method for securing an antifriction insert in a rail switching device, said switching device including a firmly mounted stock rail, a base member disposed stationary relative to said stock rail and extending perpendicularly to a longitudinal direction of said stock rail, said base member including undercut grooves, said grooves including hollows therein, and a rectangular antifriction insert having projections on the elongated sides thereof, said insert to be mounted on said base member, said method comprising the steps of:

introducing a side of said insert extending vertically with respect to said stock rail, obliquely from above into one of said grooves;

tilting said insert into a horizontal position with said projections disposed above said hollows;

lowering said insert;

pushing said insert forward in the direction of said stock rail to lock said projections in said grooves.

8. A method for securing an antifriction insert in a rail switching device, said switching device including a firmly mounted stock rail, a base member disposed stationary relative to said stock rail and extending perpendicularly to a longitudinal direction of said stock rail, said base member including undercut grooves, said grooves including hollows therein, a guard rail disposed parallel to said stock rail so that said base is disposed between said rails, said stock and guard rails defining a space therebetween, and a rectangular antifriction insert having projections on the elongated sides thereof, said insert to be mounted on said base member, said method comprising the steps of:

introducing said rectangular insert into said space, with the longer sides of said insert disposed parallel to the longitudinal direction of said stock and guard rails;

turning said insert 90 degrees to the plane defined by said base member;

orientating said projections above said hollows;

lowering said insert;

pushing said insert forward in the direction of said stock rail to lock said projections in said grooves.

* * * * *